US011355060B2

(12) United States Patent
Qing et al.

(10) Patent No.: US 11,355,060 B2
(45) Date of Patent: Jun. 7, 2022

(54) PIXEL CIRCUIT, METHOD OF DRIVING PIXEL CIRCUIT, DISPLAY PANEL AND DISPLAY DEVICE

(71) Applicants: CHENGDU BOE OPTOELECTRONICS TECHNOLOGY CO., LTD., Chengdu (CN); BOE TECHNOLOGY GROUP CO, LTD., Beijing (CN)

(72) Inventors: Haigang Qing, Beijing (CN); Yunsheng Xiao, Beijing (CN)

(73) Assignees: CHENGDU BOE OPTOELECTRONICS TECHNOLOGY CO., LTD., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 283 days.

(21) Appl. No.: 16/473,798

(22) PCT Filed: Dec. 18, 2018

(86) PCT No.: PCT/CN2018/121795
§ 371 (c)(1),
(2) Date: Jun. 26, 2019

(87) PCT Pub. No.: WO2019/205671
PCT Pub. Date: Oct. 31, 2019

(65) Prior Publication Data

US 2021/0335231 A1 Oct. 28, 2021

(30) Foreign Application Priority Data

Apr. 23, 2018 (CN) ..... 201810368233.5

(51) Int. Cl.
*G09G 3/3233* (2016.01)
*G09G 3/3258* (2016.01)
(Continued)

(52) U.S. Cl.
CPC ..... *G09G 3/3233* (2013.01); *G09G 3/3258* (2013.01); *G09G 3/3266* (2013.01);
(Continued)

(58) Field of Classification Search
CPC ..... G09G 3/3233; G09G 3/3283
See application file for complete search history.

(56) References Cited

U.S. PATENT DOCUMENTS 10,176,755 B2 1/2019 Cai
10,192,485 B2 1/2019 He et al.
(Continued)

FOREIGN PATENT DOCUMENTS

CN 102832229 A 12/2012
CN 102930824 A 2/2013
(Continued)

OTHER PUBLICATIONS

First Chinese Office Action dated Jun. 20, 2019.
(Continued)

*Primary Examiner* — Sanjiv D. Patel
(74) *Attorney, Agent, or Firm* — Dilworth & Barrese, LLP.; Michael J. Musella, Esq.

(57) ABSTRACT

A pixel circuit, a method of driving a pixel circuit, a display panel and a display device. The pixel circuit includes a light emitting drive circuit, a storage circuit, a data writing circuit, a light emitting control circuit, and a compensation circuit. The data writing circuit is configured to write a data signal into the storage circuit under a control of a scanning signal; the storage circuit is configured to store the data signal; the compensation circuit is configured to write compensation voltage information which is based on a compensation current signal into the light emitting drive circuit under a control of the scanning signal; and the light emitting control circuit is configured to control the light emitting drive circuit
(Continued)

to drive a light emitting element to emit light under a control of a light emitting control signal.

14 Claims, 7 Drawing Sheets

(51) Int. Cl.
*G09G 3/3266* (2016.01)
*G09G 3/3283* (2016.01)

(52) U.S. Cl.
CPC ... *G09G 3/3283* (2013.01); *G09G 2300/0426* (2013.01); *G09G 2300/0842* (2013.01); *G09G 2310/0278* (2013.01); *G09G 2320/0233* (2013.01); *G09G 2330/028* (2013.01)

(56) References Cited

U.S. PATENT DOCUMENTS

| | | | | |
|---|---|---|---|---|
| 10,242,616 | B2 | 3/2019 | He et al. | |
| 2004/0066357 | A1 | 4/2004 | Kawasaki | |
| 2004/0178407 | A1* | 9/2004 | Lin | G09G 3/325 257/40 |
| 2007/0024543 | A1* | 2/2007 | Chung | G09G 3/3233 345/76 |
| 2007/0279337 | A1 | 12/2007 | Kim et al. | |
| 2016/0329017 | A1* | 11/2016 | Chaji | G09G 3/3233 |
| 2017/0124954 | A1 | 5/2017 | Park et al. | |
| 2017/0193908 | A1* | 7/2017 | Wang | G09G 3/3233 |
| 2018/0068611 | A1* | 3/2018 | Chaji | G09G 3/3233 |
| 2018/0254009 | A1 | 9/2018 | Li et al. | |

FOREIGN PATENT DOCUMENTS

| | | | |
|---|---|---|---|
| CN | 105448244 | A | 3/2016 |
| CN | 105609050 | A | 5/2016 |
| CN | 205451748 | U | 8/2016 |
| CN | 105931599 | A | 9/2016 |
| CN | 106847187 | A | 6/2017 |
| CN | 106910467 | A | 6/2017 |
| CN | 107170409 | A | 9/2017 |
| CN | 108538247 | A | 9/2018 |

OTHER PUBLICATIONS

International Search Report and Written Opinion dated Mar. 18, 2019.

Third Chinese Office Action from Chinese Patent Application No. 201810368233.5 dated Dec. 14, 2021.

* cited by examiner

PIXEL CIRCUIT, METHOD OF DRIVING PIXEL CIRCUIT, DISPLAY PANEL AND DISPLAY DEVICE

CROSS REFERENCE

The present application is based on PCT/CN2018/121795, filed on Dec. 18, 2018, which claims priority of the Chinese Patent Application No. 201810368233.5, filed on Apr. 23, 2018, the entire disclosure thereof is incorporated herein by reference as part of the present application.

TECHNICAL FIELD

Embodiments of the present disclosure relate to a pixel circuit, a method of driving a pixel circuit, a display panel and a display device.

BACKGROUND

At present, technologies of active-matrix organic light emitting diode (AMOLED) display panels are becoming more and more mature, the AMOLED display panels have the characteristics of flexibility, high contrast, low power consumption and the like, and have broad development prospects. The AMOLED display panels have gradually replaced liquid crystal display (LCD) panels as a new generation of display manner. The AMOLED display panels may be widely used in electronic products, such as mobile phones, computers, full-color televisions, digital cameras, personal digital assistants, and the like.

SUMMARY

At least one embodiment of the present disclosure provides a pixel circuit, which includes a light emitting drive circuit, a storage circuit, a data writing circuit, a light emitting control circuit and a compensation circuit. The data writing circuit is configured to write a data signal into the storage circuit under a control of a scanning signal, the storage circuit is configured to store the data signal, the compensation circuit is configured to write compensation voltage information which is based on a compensation current signal into the light emitting drive circuit under a control of the scanning signal, and the light emitting control circuit is configured to control the light emitting drive circuit to drive a light emitting element to emit light under a control of a light emitting control signal.

For example, in the pixel circuit provided by at least one embodiment of the present disclosure, the light emitting drive circuit includes a light emitting drive transistor. A first electrode of the light emitting drive transistor is electrically connected to a first power supply terminal, a second electrode of the light emitting drive transistor is electrically connected to a first terminal of the light emitting element, and a gate electrode of the light emitting drive transistor is electrically connected to the compensation circuit and the storage circuit, respectively.

For example, in the pixel circuit provided by at least one embodiment of the present disclosure, the compensation circuit includes a first compensation transistor and a second compensation transistor. A first electrode of the first compensation transistor is electrically connected to the gate electrode of the light emitting drive transistor, a second electrode of the first compensation transistor is electrically connected to the second electrode of the light emitting drive transistor, and a gate electrode of the first compensation transistor is electrically connected to a scanning signal line to receive the scanning signal; and a first electrode of the second compensation transistor is electrically connected to the second electrode of the light emitting drive transistor, a second electrode of the second compensation transistor is electrically connected to a constant current source, and a gate electrode of the second compensation transistor is electrically connected to the scanning signal line to receive the scanning signal.

For example, in the pixel circuit provided by at least one embodiment of the present disclosure, the compensation circuit comprises a first compensation transistor and a second compensation transistor. A first electrode of the first compensation transistor is electrically connected to the gate electrode of the light emitting drive transistor, a second electrode of the first compensation transistor is electrically connected to the second electrode of the light emitting drive transistor, and a gate electrode of the first compensation transistor is electrically connected to a scanning signal line to receive the scanning signal; and a first electrode of the second compensation transistor is electrically connected to the gate electrode of the light emitting drive transistor, a second electrode of the second compensation transistor is electrically connected to a constant current source, and a gate electrode of the second compensation transistor is electrically connected to the scanning signal line to receive the scanning signal.

For example, in the pixel circuit provided by at least one embodiment of the present disclosure, the data writing circuit includes a data writing transistor. A first electrode of the data writing transistor is electrically connected to a data line, a second electrode of the data writing transistor is electrically connected to the storage circuit, and a gate electrode of the data writing transistor is electrically connected to the scanning signal line to receive the scanning signal.

For example, in the pixel circuit provided by at least one embodiment of the present disclosure, the storage circuit includes a storage capacitor. A first terminal of the storage capacitor is electrically connected to the second electrode of the data writing transistor, and a second terminal of the storage capacitor is electrically connected to the gate electrode of the light emitting drive transistor.

For example, in the pixel circuit provided by at least one embodiment of the present disclosure, the light emitting control circuit includes a first light emitting control transistor. A first electrode of the first light emitting control transistor is electrically connected to a third power supply terminal, a second electrode of the first light emitting control transistor is electrically connected to the first terminal of the storage capacitor, and a gate electrode of the first light emitting control transistor is electrically connected to a light emitting control line to receive the light emitting control signal.

For example, in the pixel circuit provided by at least one embodiment of the present disclosure, the first power supply terminal and the third power supply terminal are configured to output a same power supply voltage; alternatively, the first power supply terminal is integrated with the third power supply terminal.

For example, in the pixel circuit provided by at least one embodiment of the present disclosure, the light emitting control circuit further includes a second light emitting control transistor. A first electrode of the second light emitting control transistor is electrically connected to the second electrode of the light emitting drive transistor, a second electrode of the second light emitting control transistor is electrically connected to the first terminal of the light emitting element, and a gate electrode of the second light emitting control transistor is electrically connected to the light emitting control line to receive the light emitting control signal.

For example, in the pixel circuit provided by at least one embodiment of the present disclosure, the constant current source is configured to output the compensation current signal, and the light emitting drive transistor is at a saturated state in a data writing stage, and the compensation current signal flows through the light emitting drive transistor.

At least one embodiment of the present disclosure further provides a driving method applied to the pixel circuit described above, which includes: writing the data signal to the storage circuit, and writing the compensation voltage information which is based on the compensation current signal to the light emitting drive circuit, in a data writing stage; and driving the light emitting element to emit light based on the compensation voltage information, in a light emitting stage.

For example, in the driving method provided by at least one embodiment of the present disclosure, the light emitting drive circuit includes a light emitting driving transistor, and writing the compensation voltage information which is based on the compensation current signal to the light emitting drive circuit includes: writing the compensation current signal to a gate electrode of the light emitting drive transistor, and controlling the light emitting drive transistor to be at a saturated state to write the compensation voltage information to the gate electrode of the light emitting drive transistor.

At least one embodiment of the present disclosure further provides a display panel, which includes the pixel circuit described above.

For example, the display panel provided by at least one embodiment of the present disclosure further includes a constant current source, and the constant current source is configured to output the compensation current signal.

At least one embodiment of the present disclosure further provides a display device, which includes the display panel described above.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1A:
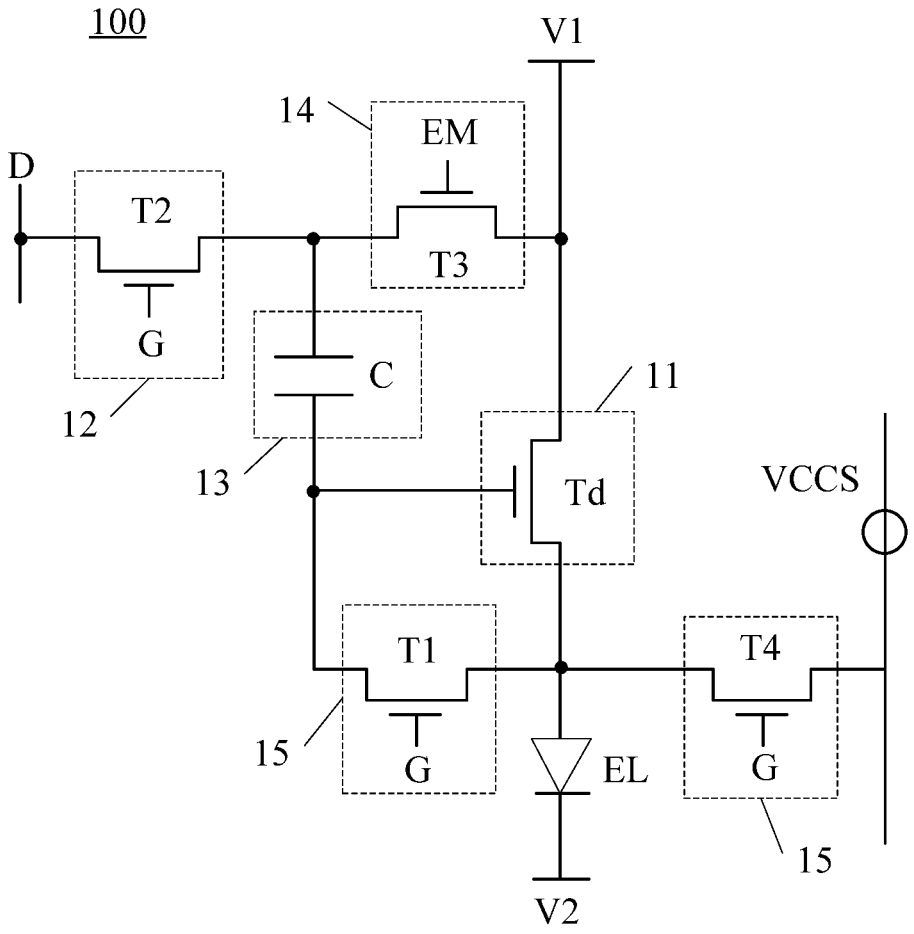
FIG. 1A is a schematic diagram of a pixel circuit according to some embodiments of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by those of ordinary skill in the art to which the present disclosure belongs. The terms "first," "second," etc., which are used in the description and the claims of the present disclosure, are not intended to indicate any sequence, amount or importance, but used to distinguish various components. The terms, such as "comprise/comprising," "include/including," or the like are intended to specify that the elements or the objects stated before these terms encompass the elements or the objects and equivalents thereof listed after these terms, but not preclude other elements or objects. The terms, such as "connect/connecting/connected," "couple/coupling/coupled" or the like, are not limited to a physical connection or mechanical connection, but may include an electrical connection/coupling, directly or indirectly. The terms, "on," "under," "left," "right," or the like are only used to indicate relative position relationship, and when the position of the object which is described is changed, the relative position relationship may be changed accordingly.

In order to keep the following description of embodiments of the present disclosure clear and concise, detailed descriptions of known functions and known components are omitted from the present disclosure.

Organic light emitting diode (OLED) display panels may be classified as passive matrix driving organic light emitting diode (PMOLED) display panels and active matrix driving organic light emitting diode (AMOLED) display panels according to driving manners. In an AMOLED display panel, each pixel may be independently controlled. Each pixel is provided with a driving thin film transistor (DTFT), and the pixel is driven by a current generated in a case where the driving thin film transistor is at a saturated state.

At present, the manufacturing process of an OLED display panels is difficult to ensure the uniformity of threshold voltages of all driving thin film transistors in the whole display panel range. In addition, in the use process, the threshold voltages of driving thin film transistors of different pixel units of the OLED display panel may drift in different degrees, and thus the OLED display panel may suffer from non-uniform brightness of respective pixels. Therefore, it is necessary to compensate threshold voltages of driving thin film transistors of each pixel.

At least one embodiment of the present disclosure provides a pixel circuit, a method of driving a pixel circuit, a display panel and a display device, which output a compensation current signal which is based on a constant current source to a light emitting drive circuit in a data writing stage, thereby compensating a threshold voltage of a light emitting drive transistor, so that a light emitting current is not affected by the threshold voltage of the light emitting drive transistor, the problem that the brightness of respective pixels are non-uniform caused by non-uniform threshold voltages of the light-emitting drive transistor of the display panel may be eliminated, and display uniformity and display effects may be improved. In addition, the pixel circuit according to at least one embodiment of the present disclosure has a simple structure, and is easy to design and manufacture. The pixel circuit has relatively few types of driving signals, and thus it is easy to control pixels.

For example, according to the characteristics of active layers of transistors, the transistors may be classified as N-type transistors and P-type transistors. For clarity, the embodiments of the present disclosure take that transistors are P-type transistors (e.g., P-type MOS transistors) as an example to illustrate the technical solutions of the present disclosure, however, the transistors of the embodiment of the present disclosure are not limited to the P-type transistors, and those skilled in the art may also utilize N-type transistors (e.g., N-type MOS transistors) to implement the functions of one or more transistors in the embodiments of the present disclosure according to actual needs.

It should be noted that the transistors used in the embodiments of the present disclosure may be thin film transistors or field effect transistors or other switching devices having the same characteristics, in which the thin film transistors may include oxide semiconductor thin film transistors, amorphous silicon thin film transistors or poly-silicon thin film transistors, etc. A source electrode and a drain electrode of a transistor may be symmetrical in structure, so the source electrode and the drain electrode of the transistor may be indistinguishable in physical structure. In order to distinguish transistors, in the embodiments of the present disclosure, except for a gate electrode serving as a control electrode, one of the electrodes is directly described as a first electrode, and the other as a second electrode. Therefore, the first electrode and the second electrode of all or part of the transistors in the embodiments of the present disclosure are interchangeable as required.

Several embodiments of the present disclosure are illustrated in detail below with reference to the accompanying drawings, but the present disclosure is not limited to these specific embodiments.

Figure 1B:
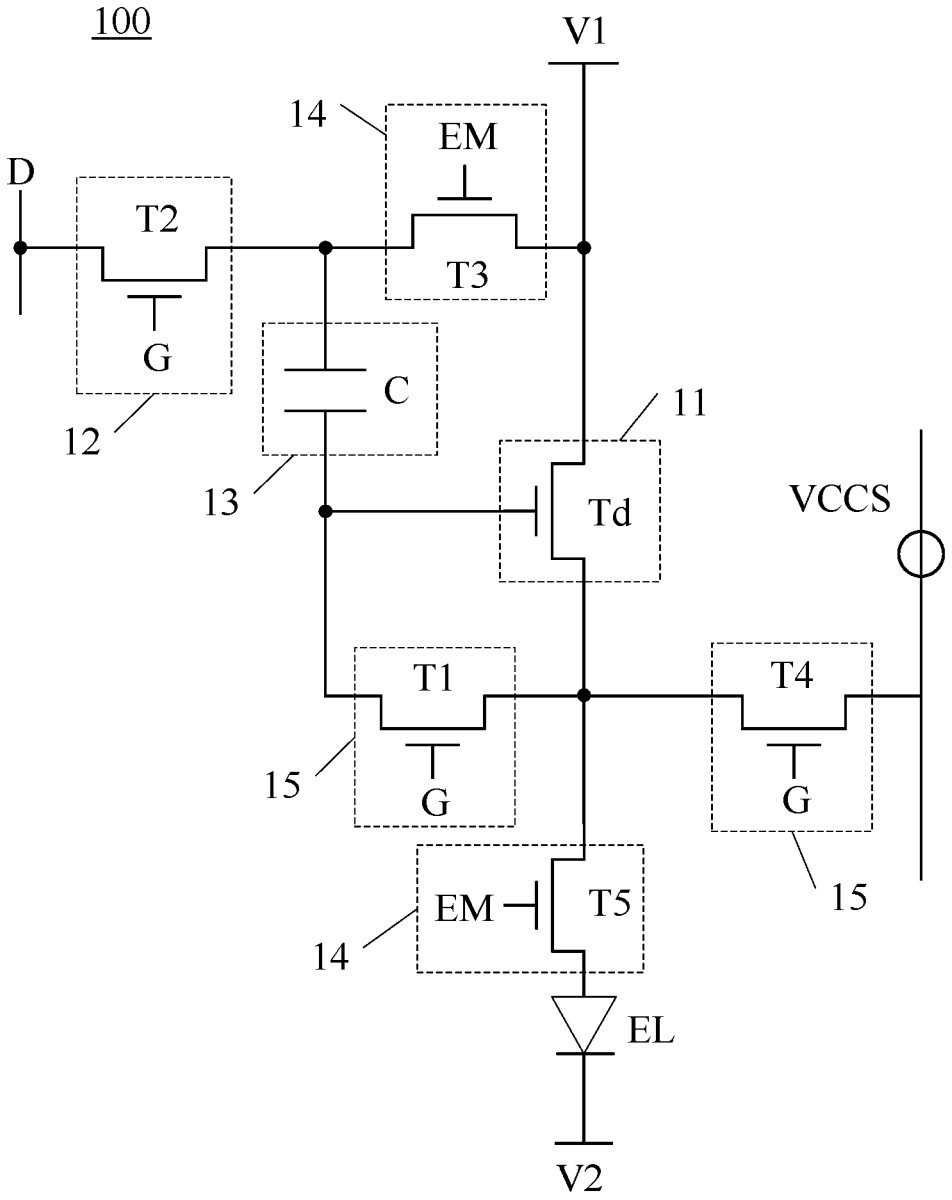
FIG. 1B is a schematic diagram of another pixel circuit according to some embodiments of the present disclosure.

FIG. 1A is a schematic diagram of a pixel circuit according to some embodiments of the present disclosure, and FIG. 1B is a schematic diagram of another pixel circuit according to some embodiments of the present disclosure.

For example, as illustrated in FIG. 1A, a pixel circuit 100 according to an embodiment of the present disclosure includes a light emitting drive circuit 11, a data writing circuit 12, a storage circuit 13, a light emitting control circuit 14, and a compensation circuit 15, for controlling and driving a light emitting element EL to emit light. The data writing circuit 12 is configured to write a data signal D (or a data signal $V_{data}$) into the storage circuit 13 under a control of a scanning signal G (or a scanning signal Vg); the storage circuit 13 is configured to store the data signal $V_{data}$; the compensation circuit 15 is configured to write compensation voltage information which is based on a compensation current signal VCCS (or a compensation current signal Iref) into the light emitting drive circuit 11 under a control of the scanning signal Vg; and the light emitting control circuit 14 is configured to control the light emitting drive circuit 11 to drive the light emitting element EL to emit light under a control of a light emitting control line EM (or a light emitting control signal $V_{EM}$).

For example, the pixel circuit 100 according to the above embodiment of the present disclosure may be applied to a display panel, such as an AMOLED display panel.

For example, as illustrated in FIG. 1A, the light emitting drive circuit 11 includes a light emitting drive transistor Td. A first electrode of the light emitting drive transistor Td is electrically connected to a first power supply terminal V1, a second electrode of the light emitting drive transistor Td is electrically connected to a first terminal of the light emitting element EL (a positive terminal of the light emitting element EL in this embodiment), and a gate electrode of the light emitting drive transistor Td is electrically connected to the compensation circuit 15 and the storage circuit 13, respectively. A second terminal of the light emitting element EL (a negative terminal of the light emitting element EL in this embodiment) is electrically connected to a second power supply terminal V2.

For example, the light emitting drive transistor Td may be a P-type transistor. A first electrode of the light emitting drive transistor Td may be a source electrode, and a second electrode of the light emitting drive transistor Td may be a drain electrode.

For example, the light emitting element EL may be a light emitting diode or the like. The light emitting diode may be an organic light emitting diode (OLED) or a quantum dot light emitting diode (QLED) or the like. The light emitting element EL is configured to receive a light emitting signal (e.g., may be a current signal) and emit light of an intensity corresponding to an amplitude of the light emitting signal during operation.

For example, one of the first power supply terminal V1 and the second power supply terminal V2 is a high voltage terminal and the other is a low voltage terminal. For example, in the embodiment illustrated in FIG. 1A, the first power supply terminal V1 is a voltage source for outputting a constant positive voltage, and the second power supply terminal V2 may be a voltage source for outputting a constant negative voltage, or may be grounded or the like.

For example, as illustrated in FIG. 1A, the compensation circuit 15 may include a first compensation transistor T1 and a second compensation transistor T4. A first electrode of the first compensation transistor T1 is electrically connected to the gate electrode of the light emitting drive transistor Td, a second electrode of the first compensation transistor T1 is electrically connected to the second electrode of the light emitting drive transistor Td, and a gate electrode of the first compensation transistor T1 is electrically connected to a scanning signal line G to receive the scanning signal Vg. A first electrode of the second compensation transistor T4 is electrically connected to the second electrode of the light emitting drive transistor Td, a second electrode of the second compensation transistor T4 is electrically connected to a constant current source VCCS, and a gate electrode of the second compensation transistor T4 is electrically connected to the scanning signal line G to receive the scanning signal Vg.

For example, the constant current source VCCS is configured to output the compensation current signal Iref. For example, the compensation current signal Iref may be between a picoampere (pA) level and a nanoampere (nA) level.

For example, as illustrated in FIG. 1A, the data writing circuit 12 includes a data writing transistor T2. A first electrode of the data writing transistor T2 is electrically connected to a data line D to receive the data signal $V_{data}$, a second electrode of the data writing transistor T2 is electrically connected to the storage circuit 13, and a gate electrode of the data writing transistor T2 is electrically connected to the scanning signal line G to receive the scanning signal Vg.

For example, as illustrated in FIG. 1A, the storage circuit 13 includes a storage capacitor C. A first terminal of the storage capacitor C is electrically connected to the second electrode of the data writing transistor T2, and a second terminal of the storage capacitor C is electrically connected to the gate electrode of the light emitting drive transistor Td.

For example, in a data writing stage, the scanning signal line G may provide the scanning signal Vg to the gate electrode of the first compensation transistor T1 and the gate electrode of the second compensation transistor T4, so that the first compensation transistor T1 and the second compensation transistor T4 are turned on. In the data writing stage, because both the first compensation transistor T1 and the second compensation transistor T4 are turned on, the constant current source VCCS is turned on with the gate electrode of the light emitting drive transistor Td, and a gate voltage of the light emitting drive transistor Td is pulled down, so that the gate electrode of the light emitting drive transistor Td is reset, and the light emitting drive transistor Td is at a saturated state, that is, at an on-state.

For example, in the data writing stage, the scanning signal line G may also provide the scanning signal Vg to the gate electrode of the data writing transistor T2, so as to turn on the data writing transistor T2. Thus, the data writing transistor T2 may transmit the data signal $V_{data}$ on the data line D to the first terminal of the storage capacitor C, and the storage capacitor C may store the data voltage (i.e., the data signal) $V_{data}$.

In summary, in the data writing stage, the scanning signal Vg may simultaneously control the data writing transistor T2, the first compensation transistor T1 and the second compensation transistor T4 to be turned on, so that the data writing transistor T2 may transmit the data signal $V_{data}$ to the storage capacitor C, and meanwhile, the gate electrode of the light emitting drive transistor Td is reset.

For example, in the data writing stage, since the first compensation transistor T1 is turned on, the gate electrode of the light emitting drive transistor Td is electrically connected with the second electrode of the light emitting drive transistor Td, so that the light emitting drive transistor Td is at a saturated state, thereby forming a conductive path from the first power supply terminal V1 to the constant current source VCCS. According to a saturation current formula of the light emitting drive transistor Td, a saturation current $I_1$ flowing through the light emitting drive transistor Td may be represented as:

$$I_1 = \tfrac{1}{2}K(V_{gs1} - Vth)$$

Where K is a process constant of the light emitting drive transistor Td, $V_{gs1}$ is a voltage difference (Vg−Vs) between the gate electrode and the source electrode (i.e., the first electrode) of the light emitting drive transistor Td in the data writing stage, and $V_{th}$ is a threshold voltage of the light emitting drive transistor Td. For example, K may be represented as:

$$K = 0.5\mu_n C_{ox}(W/L)$$

Where $\mu_n$ is an electron mobility of the light emitting drive transistor Td, $C_{ox}$ is a gate electrode unit capacitance of the light emitting drive transistor Td, W is a channel width of the light emitting drive transistor Td, and L is a channel length of the light emitting drive transistor Td.

For example, in the data writing stage, the compensation current signal Iref flows through the light emitting drive transistor Td, and the compensation current signal Iref is the same as a saturation current $I_1$ of the light emitting drive transistor Td, that is, $I_1$=Iref. A voltage Vs of the first electrode of the light emitting drive transistor Td is equal to a power supply voltage Vdd output from the first power supply terminal V1, that is, Vs=Vdd. Therefore, according to the above formula of the saturation current $I_1$, a gate voltage Vg of the light emitting drive transistor Td may be represented as:

$$V_g = Vdd - \sqrt{\frac{2Iref}{K}} + Vth.$$

For example, the compensation circuit 15 is configured to write compensation voltage information based on a compensation current signal to a gate electrode of the light emitting drive transistor Td under a control of a scanning signal, and the compensation voltage information may be a gate voltage Vg of the light emitting drive transistor Td in the data writing stage. A second terminal of the storage circuit C is configured to store the compensation voltage information.

In the pixel circuit 100 according to the above embodiment of the present disclosure, in the data writing stage, under a control of the same driving signal (i.e., the scanning signal Vg), the data signal may be written into the storage capacitor, meanwhile, the gate electrode of the light emitting drive transistor may be reset, and then the compensation voltage information based on the compensation current signal can be written into the gate electrode of the light emitting drive transistor, that is, a reset stage and the data writing stage are controlled by the same driving signal, and performed simultaneously, so that types of driving signals of the pixel circuit may be reduced, and the control of the pixel circuit can be simplified; and the number of wirings used in the display panel that includes the pixel circuit may be reduced, thereby increasing a aperture ratio and costing down.

For example, as illustrated in FIG. 1A, the light emitting control circuit 14 includes a first light emitting control transistor T3. A first electrode of the first light emitting control transistor T3 is electrically connected to a third power supply terminal (not shown), a second electrode of the first light emitting control transistor T3 is electrically connected to the first terminal of the storage capacitor C, and a gate electrode of the first light emitting control transistor T3 is electrically connected to a light emitting control line EM to receive a light emitting control signal $V_{EM}$.

For example, the first power supply terminal V1 and the third power supply terminal may be configured to output a same power supply voltage. Alternatively, as illustrated in FIG. 1A, the first power supply terminal V1 and the third power supply terminal are integrated or electrically connected to each other, that is, the first electrode of the first light emitting control transistor T3 is also electrically connected to the first power supply terminal V1.

For example, in a light emitting stage, the light emitting control line EM may provide the light emitting control signal $V_{EM}$ to the first light emitting control transistor T3 to turn on the first light emitting control transistor T3. Meanwhile, both the first compensation transistor T1 and the second compensation transistor T4 are turned off (i.e., off), and a light emitting current from the first power supply terminal V1 may be transmitted to the light emitting element EL via the light emitting drive transistor Td which is turned on to drive the light emitting element EL to emit light.

For example, as illustrated in FIG. 1B, in another example, the light emitting control circuit 14 may further include a second light emitting control transistor T5. For example, a first electrode of the second light emitting control transistor T5 is electrically connected to the second electrode of the light emitting drive transistor Td, a second electrode of the second light emitting control transistor T5 is electrically connected to the first terminal of the light emitting element EL, and a gate electrode of the second light emitting control transistor T5 is electrically connected to the light emitting control line EM to receive the light emitting control signal $V_{EM}$.

For example, the light emitting drive transistor Td is electrically connected to the light emitting element EL through the second light emitting control transistor T5, so that the second light emitting control transistor T5 may turn off the light emitting drive transistor Td and the light emitting element EL in the data writing stage to ensure that the light emitting element EL does not emit light, thereby improving the contrast of a display panel.

It should be noted, in the example illustrated in FIG. 1B, the gate electrode of the first light emitting control transistor T3 and the gate electrode of the second light emitting control transistor T5 are connected to the same light emitting control line EM to receive the same light emitting control signal $V_{EM}$. However, the embodiments of the present disclosure are not limited to this. The gate electrode of the first light emitting control transistor T3 and the gate electrode of the second light emitting control transistor T5 may also be electrically connected to different light emitting control lines, and light emitting control signals applied by the different light emitting control lines are synchronized. That is, the embodiments of the present disclosure are not limited thereto.

For example, in the light emitting stage, both the first compensation transistor T1 and the second compensation transistor T4 are turned off, and the light emitting control signal $V_{EM}$ is simultaneously applied to the gate electrode of the first light emitting control transistor T3 and the gate electrode of the second light emitting control transistor T5 so that the first light emitting control transistor T3 and the second light emitting control transistor T5 are simultaneously turned on. Thus, the first power supply terminal V1, the light emitting drive transistor Td, the second light emitting control transistor T5, the light emitting element EL, and the second power supply terminal V2 may form a loop, and a light emitting current is transmitted to the light emitting element EL via the light emitting drive transistor Td and the second light emitting control transistor T5 which are turned on to drive the light emitting element EL to emit light.

For example, the compensation voltage information may control a conduction degree of the light emitting drive transistor Td, thereby a magnitude of a light emitting current flowing through the light emitting drive transistor Td may be controlled, in which the light emitting current flowing through the light emitting drive transistor Td may determine a light emitting intensity of the light emitting element EL.

Figure 2A:
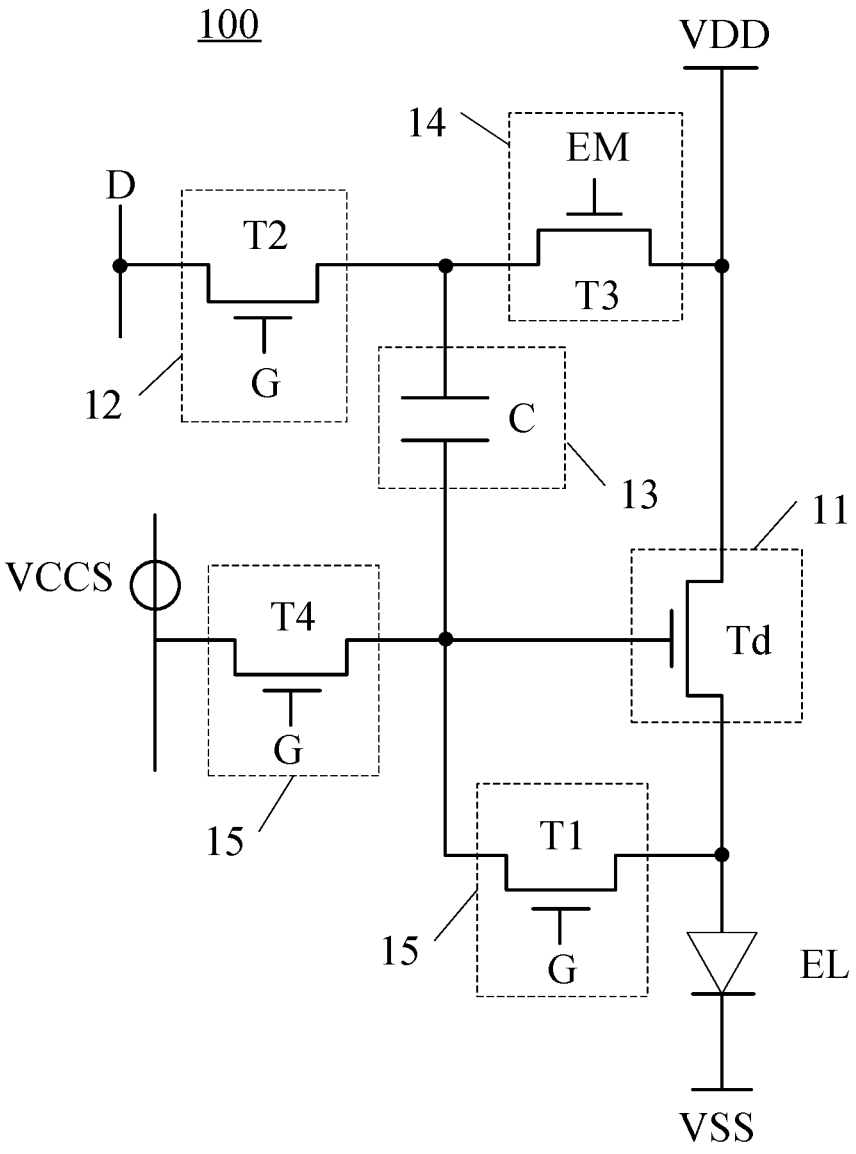
FIG. 2A is a schematic diagram of a pixel circuit according to other embodiments of the present disclosure.
Figure 2B:
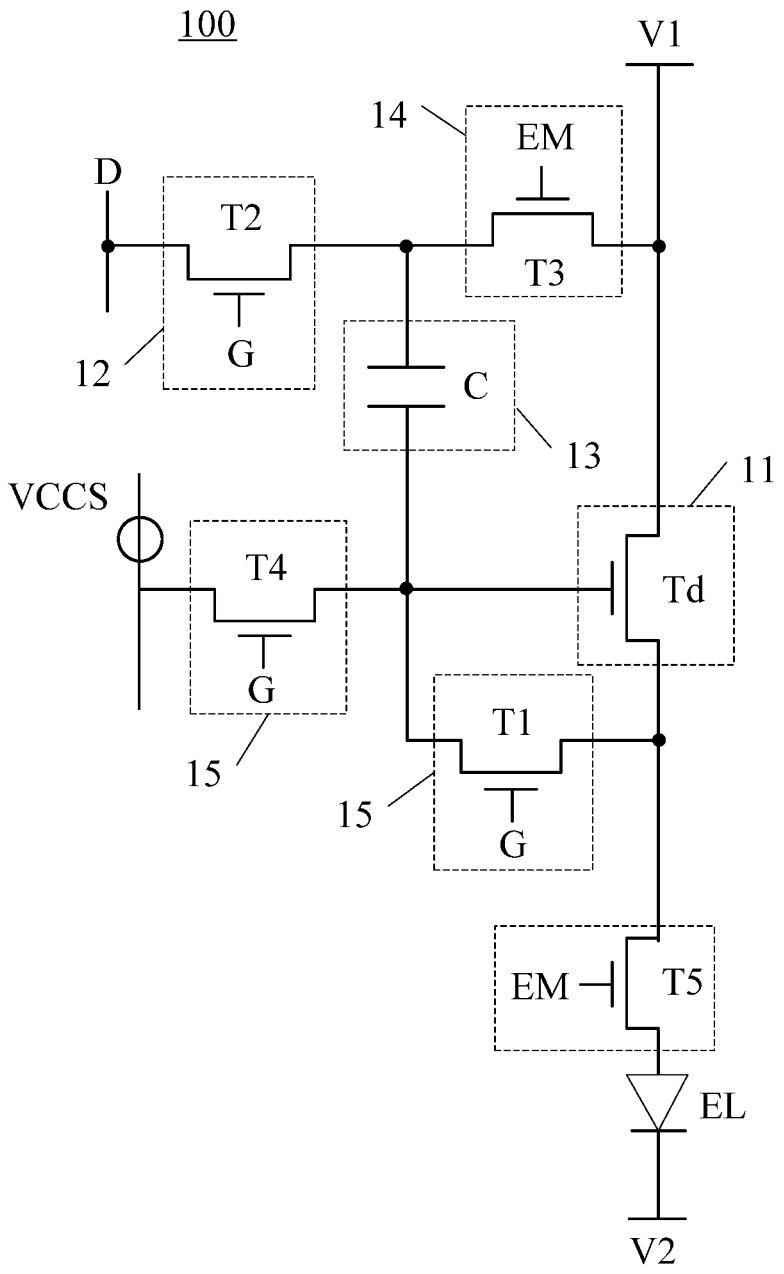
FIG. 2B is a schematic diagram of another pixel circuit according to other embodiments of the present disclosure.

FIG. 2A is a schematic diagram of a pixel circuit according to another embodiment of the present disclosure, and FIG. 2B is a schematic diagram of another pixel circuit according to another embodiment of the present disclosure.

For example, as illustrated in FIGS. 2A and 2B, the compensation circuit 15 includes a first compensation transistor T1 and a second compensation transistor T4. In the embodiment illustrated in FIGS. 2A and 2B, the connection manner of the second compensation transistor T4 is different from that of the embodiment illustrated in FIGS. 1A and 1B.

For example, a first electrode of the first compensation transistor T1 is electrically connected to the gate electrode of the light emitting drive transistor Td, a second electrode of the first compensation transistor T1 is electrically connected to the second electrode of the light emitting drive transistor Td, and a gate electrode of the first compensation transistor T1 is electrically connected to a scanning signal line G to receive a scanning signal Vg. A first electrode of the second compensation transistor T4 is electrically connected to the gate electrode of the light emitting drive transistor Td, a second electrode of the second compensation transistor T4 is electrically connected to a constant current source VCCS, and a gate electrode of the second compensation transistor T4 is electrically connected to the scanning signal line G to receive the scanning signal Vg.

It should be noted that in the embodiment illustrated in FIG. 2A, the remaining circuits (e.g., the light emitting drive circuit 11, the data writing circuit 12, the storage circuit 13, the light emitting control circuit 14, etc.) may have the same structure and connection manner as the corresponding circuits in the embodiment illustrated in FIG. 1A, and in the embodiment illustrated in FIG. 2B, the remaining circuits (e.g., the light emitting drive circuit 11, the data writing circuit 12, the storage circuit 13, the light emitting control circuit 14, etc.) may have the same structure and connection manner as the corresponding circuits in the embodiment illustrated in FIG. 1B, and will not be repeated here.

It should be noted that the light emitting drive circuit 11, the data writing circuit 12, the storage circuit 13, the light emitting control circuit 14 and the compensation circuit 15 are not limited to the structures described in the above embodiments, and their specific structures may be determined according to actual application requirements, and the embodiments of the present disclosure are not specifically limited to this.

An embodiment of the present disclosure also provides a driving method of a pixel circuit, which may be applied to the pixel circuit described above.

Figure 3:
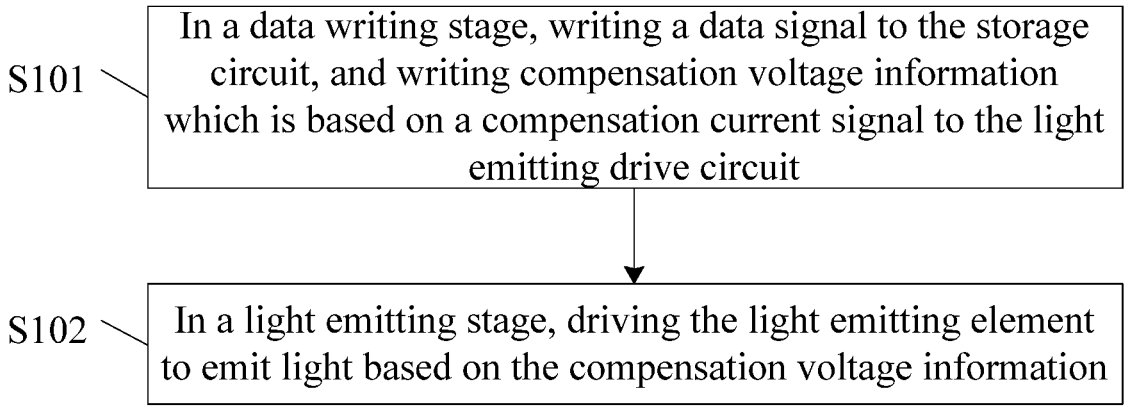
FIG. 3 is a schematic flow chart of a driving method of a pixel circuit according to some embodiments of the present disclosure.

FIG. 3 is a schematic flow chart of a driving method of a pixel circuit according to an embodiment of the present disclosure. As illustrated in FIG. 3, the driving method of the pixel circuit includes the following steps.

Step S101: in a data writing stage, writing a data signal to the storage circuit, and writing compensation voltage information which is based on a compensation current signal to the light emitting drive circuit.

Step S102: in a light emitting stage, driving the light emitting element to emit light based on the compensation voltage information.

For example, the light emitting drive circuit 11 includes a light emitting drive transistor Td. In step S101, writing the compensation voltage information which is based on the compensation current signal to the light emitting drive circuit includes: writing the compensation current signal to the gate electrode of the light emitting drive transistor, and controlling the light emitting drive transistor to be at a saturated state, to write the compensation voltage information to the gate electrode of the light emitting drive transistor.

For example, a timing chart of the pixel circuit may be determined according to actual requirements, and the embodiments of the present disclosure are not specifically limited to this.

Figure 4:
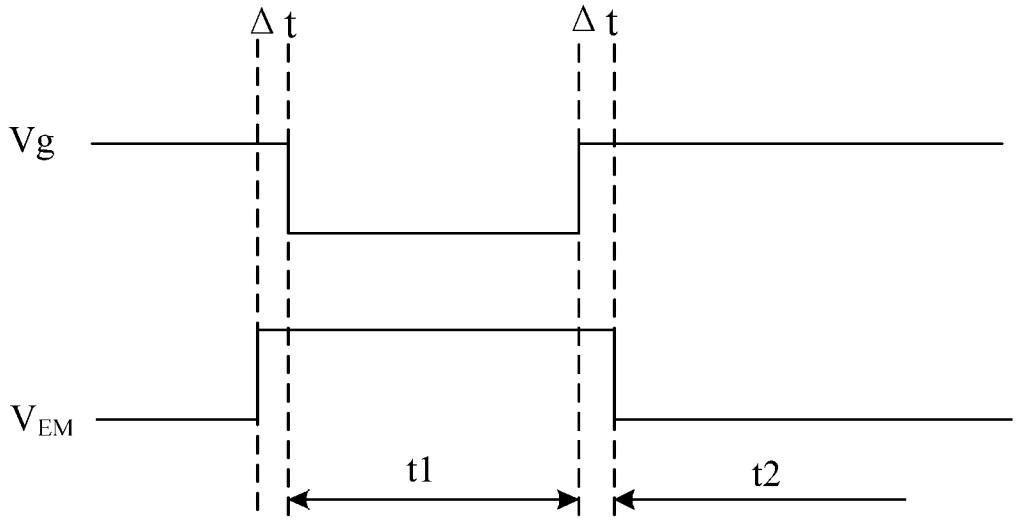
FIG. 4 is an exemplary timing diagram of a driving method of a pixel circuit according to some embodiments of the present disclosure.

For example, in an example, FIG. 4 is an exemplary timing chart of a driving method of the pixel circuit illustrated in FIGS. 1A-2B. For example, FIGS. 5A and 5B are schematic diagrams of the pixel circuit illustrated in FIG. 1A at respective stages of operation.

An operational flow of a driving method of the pixel circuit according to the embodiments of the present disclosure is described in detail below with reference to FIGS. 1A, 4, 5A and 5B.

Figure 5A:
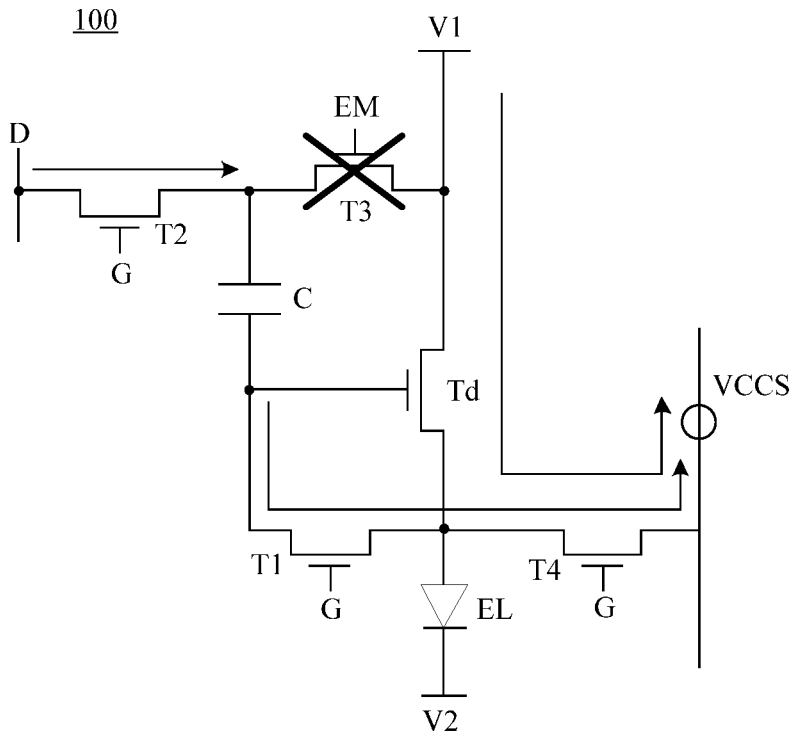
FIG. 5A is a schematic diagram of the pixel circuit illustrated in FIG. 1A in a data writing stage.
Figure 5B:
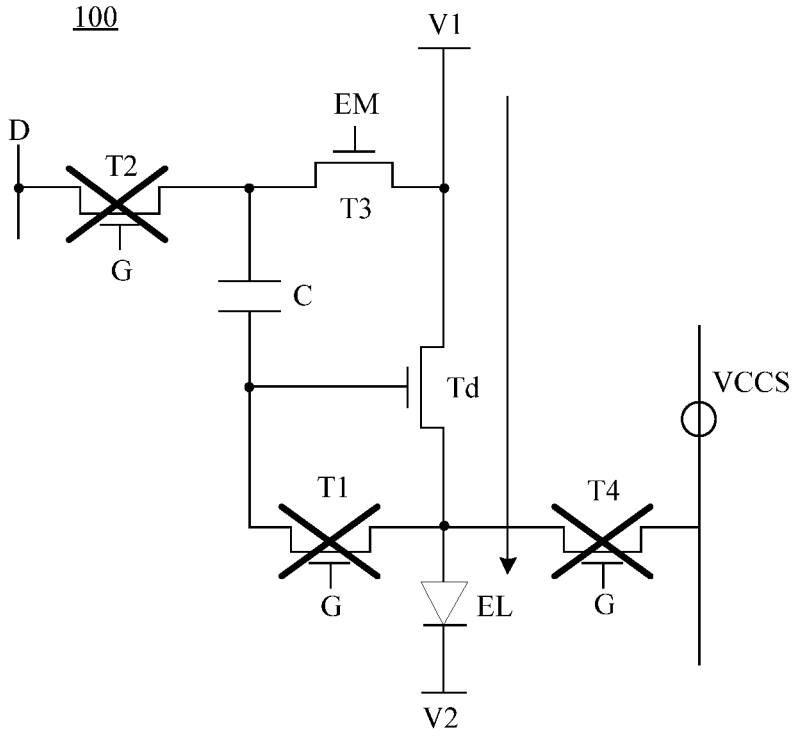
FIG. 5B is a schematic diagram of the pixel circuit illustrated in FIG. 1A in a light emitting stage.

It should be noted that in FIGS. 5A and 5B, setting a cross (x) at a transistor indicates that the transistor is at an off-state, and setting no symbol at a transistor indicates that the transistor is at an on-state. A solid line with an arrow indicates a flow direction of a signal or current.

For example, as illustrated in FIGS. 1A, 4, and 5A, in a data writing stage t1, a light emitting control signal $V_{EM}$ provided by the light emitting control line EM is a high level signal, so that the first light emitting control transistor T3 is turned off. A scanning signal Vg provided by the scanning signal line G is a low level signal, so that the data writing transistor T2, the first compensation transistor T1, and the second compensation transistor T4 are all turned on. Thus, the data signal $V_{data}$ charges the first terminal of the storage capacitor C via the data writing transistor T2, thereby a voltage of the first terminal of the storage capacitor C is $V_{data}$. At this time, the constant current source VCCS is in communication with the gate electrode of the light emitting drive transistor Td, so that a gate voltage of the light emitting drive transistor Td is pulled down. Meanwhile, since the gate electrode of the light emitting drive transistor Td is in communication with the second electrode (drain electrode at this time), the light emitting drive transistor Td is at a saturated state, that is, at an on-state, and the second terminal of the storage capacitor C is also charged. According to a saturation current formula of the light emitting drive transistor Td, a saturation current $I_1$ flowing through the light emitting drive transistor Td may be represented as:

$$I_1 = \tfrac{1}{2}K(Vgs - Vth)$$

Where K is a process constant of the light emitting drive transistor Td, $V_{gs}$ is a voltage difference (Vg−Vs) between the gate electrode and the source electrode (i.e., the first electrode) of the light emitting drive transistor Td, and $V_{th}$ is a threshold voltage of the light emitting drive transistor Td.

For example, in the data writing stage t1, the constant current source VCCS is configured to output a compensation current signal Iref and the compensation current signal Iref flows through the light emitting drive transistor Td. The compensation current signal Iref is the same as the saturation current $I_1$ of the light emitting drive transistor, that is, $I_1$=Iref. A voltage Vs of the first electrode of the light emitting drive transistor Td is equal to a power supply voltage Vdd output from the first power supply terminal V1, that is, Vs=Vdd.

Therefore, according to the above formula of the saturation current $I_1$, a gate voltage Vg of the light emitting drive transistor Td may be represented as:

$$V_g = Vdd - \sqrt{\frac{2Iref}{K}} + Vth.$$

For example, as illustrated in FIG. 1A, since the second terminal of the storage capacitor c is electrically connected to the gate electrode of the light emitting drive transistor Td, a voltage of the second terminal of the storage capacitor C is equal to the gate voltage Vg of the light emitting drive transistor Td. At this time, a voltage difference ΔV between the second terminal and the first terminal of the storage capacitor C is Vg−$V_{data}$.

For example, as illustrated in FIGS. 1A, 4, and 5B, in a light emitting stage t2, a light emitting control signal $V_{EM}$ provided by the light emitting control line EM is a low level signal, so that the first light emitting control transistor T3 is turned on. A scanning signal Vg provided by the scanning signal line G is a high level signal, so that the data writing transistor T2, the first compensation transistor T1, and the second compensation transistor T4 are all turned off. Thus, the power supply voltage Vdd output from the first power supply terminal V1 is written to the first terminal of the storage capacitor C, that is, the voltage of the first terminal of the storage capacitor C becomes Vdd at this time. Due to the low of charge conservation and a charge retention capability of the storage capacitor C, the voltage difference ΔV between the first terminal and the second terminal of the storage capacitor C remains unchanged, and the voltage of the second terminal of the storage capacitor C (i.e., the gate voltage Vg of the light emitting drive transistor Td) becomes Vdd+ΔV, i.e., becomes:

$$2Vdd - V_{data} - \sqrt{\frac{2Iref}{K}} + Vth$$

From the above analysis, it can be seen that in the two stages (the data writing stage and the light emitting stage), a corresponding relationship between the voltages of the gate electrode and the first electrode of the light emitting drive transistor Td may be illustrated in TABLE 1 below.

TABLE 1

| Operational stage | the gate electrode of the light emitting drive transistor Td | the first electrode of the light emitting drive transistor Td |
|---|---|---|
| t1 | $Vdd - \sqrt{\frac{2Iref}{K}} + Vth$ | Vdd |
| t2 | $2Vdd - V_{data} - \sqrt{\frac{2Iref}{K}} + Vth$ | Vdd |

For example, in the light emitting stage t2, a gate-source voltage Vgs2 of the light emitting drive transistor Td is represented as:

$$V_{gs2} = V_g - V_s = Vdd - V_{data} - \sqrt{\frac{2Iref}{K}} + Vth$$

By controlling a magnitude of the compensation current signal Iref, Vgs2 may be smaller than $V_{th}$, that is, the light emitting drive transistor Td is turned on. For example, the compensation current signal Iref is between a picoampere (pA) level and a nanoampere (nA) level.

For example, referring to TABLE 1, in the light emitting stage t2, based on the saturation current formula of the light emitting drive transistor Td, a light emitting current $I_{OLED}$ flowing through the light emitting drive transistor Td may be obtained and represented as:

$$I_{OLED} = \frac{1}{2}K(V_{gs2} - Vth) = \frac{1}{2}K\left(Vdd - V_{data} - \sqrt{\frac{2Iref}{K}} + Vth - Vth\right) = \frac{1}{2}K\left(Vdd - V_{data} - \sqrt{\frac{2Iref}{K}}\right)$$

As can be seen from the above formula, a light emitting current $I_{OLED}$ of the light emitting element EL is not affected by the threshold voltage $V_{th}$ of the light emitting drive transistor Td, but is only related to the data signal $V_{data}$ and the power supply voltage Vdd. The data signal $V_{data}$ is directly transmitted by the data line D, and the power supply voltage Vdd is directly transmitted by the first power supply terminal V1, which are independent of the threshold voltage $V_{th}$ of the light emitting drive transistor Td. Thus, the problem of threshold voltage drift of the light emitting drive transistor Td due to process procedures and long-term operations may be solved, the accuracy of the light emitting current $I_{OLED}$ may be ensured, the influence of the threshold voltage of the light emitting drive transistor Td on the light emitting current $I_{OLED}$ may be eliminated, the normal operation of the light emitting element EL may be ensured, the uniformity of a display picture may be improved, and the display effects may be improved.

For example, as illustrated in FIG. 4, in some embodiments of the present disclosure, there is a delay between the effective light emitting control signal $V_{EM}$ (low level signal) and the effective scanning signal Vg (low level signal), for example, the delay time may be Δt, thereby it is prevented from that the transistors in the pixel circuit (e.g., the data writing transistor T2, the first light emitting control transistor T3, the first compensation transistor T1, and the second compensation transistor T4) are turned on simultaneously, causing signals to interfere with each other.

Figure 6:
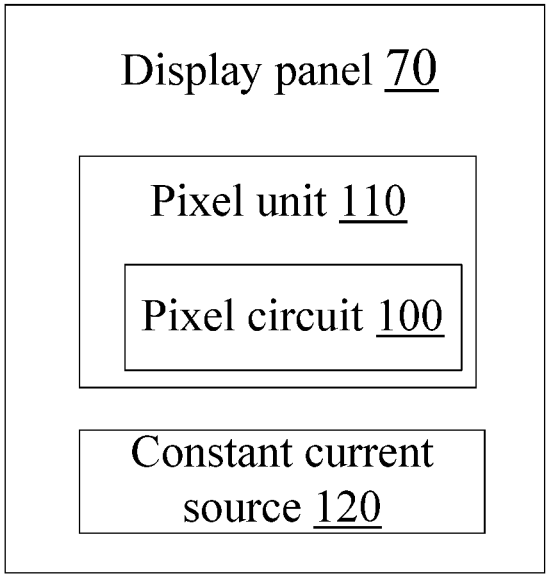
FIG. 6 is a schematic block diagram of a display panel according to some embodiments of the present disclosure.

Some embodiments of the present disclosure also provide a display panel. FIG. 6 is a schematic block diagram of a display panel according to an embodiment of the disclosure. As illustrated in FIG. 6, the display panel 70 includes a plurality of pixel units 110, which may be arranged in form of an array. Each pixel unit 110 may include the pixel circuit 100 and the light emitting element EL described in any embodiments above. The pixel circuit 100 outputs a compensation current signal which is based on a constant current source to a light emitting drive circuit in a data writing stage, thereby compensating a threshold voltage of a light emitting drive transistor, so that a light emitting current is not affected by the threshold voltage of the light emitting drive transistor, the problem that the brightness of respective pixels are non-uniform caused by non-uniform threshold voltages of the light-emitting drive transistor of the display panel may be eliminated, and display uniformity and display effects may be improved. In addition, the pixel circuit has a simple structure, and is easy to design and manufacture. The pixel circuit has relatively few types of driving signals, and thus the control of pixels can be simplified.

For example, the display panel 70 may be a rectangular panel, a circular panel, an oval panel, a polygonal panel, or the like. In addition, the display panel 70 may be not only a planar panel, but also a curved panel or even a spherical panel.

For example, the display panel 70 may also have a touch function, that is, the display panel 70 may be a touch display panel, and a touch structure may be disposed in or on the display structure (facing a display side of the display panel).

For example, as illustrated in FIG. 6, the display panel 70 further includes a constant current source 120. The constant current source is configured to output a compensation current signal.

Figure 7:
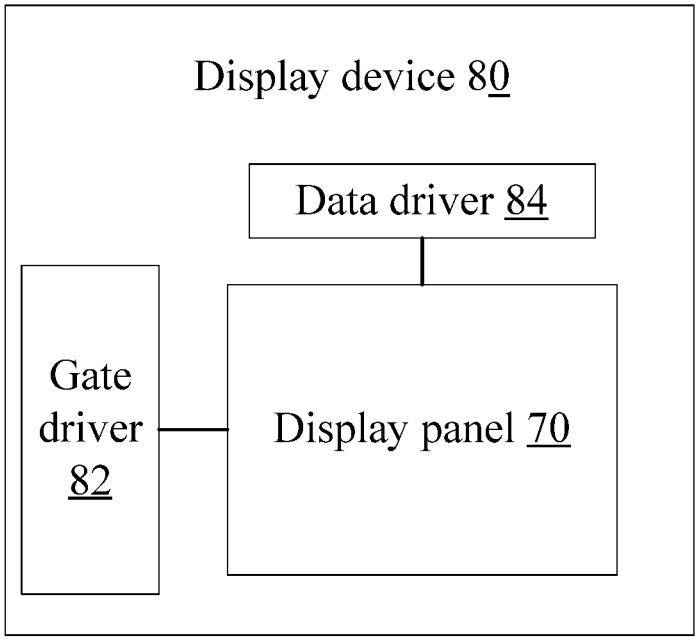
FIG. 7 is a schematic block diagram of a display device according to some embodiments of the present disclosure.

The embodiments of the present disclosure also provide a display device. FIG. 7 is a schematic block diagram of a display device according to an embodiment of the present disclosure. As illustrated in FIG. 7, a display device 80 may include the display panel 70 described in any one embodiment above, and the display panel 70 is used for displaying images.

For example, the display device 80 may further include a gate driver 82. The gate driver 82 is configured to be electrically connected to a data writing circuit through a scanning signal line for providing a scanning signal to the data writing circuit.

For example, the display device 80 may further include a data driver 84. The data driver 84 is configured to be electrically connected to the data writing circuit through a data line for providing a data signal to the display panel 70.

For example, the display device 80 may be any product or component having a display function, such as a mobile phone, a tablet computer, a television, a display, a notebook computer, a digital photo frame, a navigator.

It should be noted that other components of the display device 80 (e.g., control device, image data encoding/decoding device, clock circuit, etc.) should be understood by those of ordinary skill in the art. This will not be repeated here, and should not be taken as limitations to the present disclosure.

For the present disclosure, the following statements should be noted:

(1) The accompanying drawings involve only the structure(s) in connection with the embodiment(s) of the present disclosure, and other structure(s) can be referred to common design(s).

(2) In case of no conflict, the embodiments of the present disclosure and features in the embodiments may be combined with each other to obtain new embodiments.

What are described above is related to the specific embodiments of the disclosure only and not limitative to the scope of the disclosure, and the scopes of the disclosure are defined by the accompanying claims.

What is claimed is:

1. A pixel circuit, comprising: a light emitting drive circuit, a storage circuit, a data writing circuit, a light emitting control circuit and a compensation circuit, wherein the data writing circuit is configured to write a data signal into the storage circuit under a control of a scanning signal;

the storage circuit is configured to store the data signal;

the compensation circuit is configured to write compensation voltage information which is based on a compensation current signal into the light emitting drive circuit under a control of the scanning signal;

the light emitting control circuit is configured to control the light emitting drive circuit to drive a light emitting element to emit light under a control of a light emitting control signal;

the light emitting drive circuit comprises a light emitting drive transistor, and a first electrode of the light emitting drive transistor is electrically connected to a first power supply terminal, a second electrode of the light emitting drive transistor is electrically connected to a first terminal of the light emitting element, and a gate electrode of the light emitting drive transistor is electrically connected to the compensation circuit and the storage circuit, respectively;

the compensation circuit comprises a first compensation transistor and a second compensation transistor, and a first electrode of the first compensation transistor is directly connected to the gate electrode of the light emitting drive transistor, a second electrode of the first compensation transistor is directly connected to the second electrode of the light emitting drive transistor, and a gate electrode of the first compensation transistor is electrically connected to a scanning signal line to receive the scanning signal; and the first electrode of the second compensation transistor is directly connected to the gate electrode of the light emitting drive transistor, the second electrode of the second compensation transistor is electrically connected to a constant current source, and the gate electrode of the second compensation transistor is electrically connected to the scanning signal line to receive the scanning signal;

the data writing circuit comprises a data writing transistor, and a first electrode of the data writing transistor is electrically connected to a data line, a second electrode of the data writing transistor is electrically connected to the storage circuit, and a gate electrode of the data writing transistor is electrically connected to the scanning signal line to receive the scanning signal, the storage circuit comprises a storage capacitor, the storage capacitor is used for coupling the first power supply terminal to the gate electrode of the light emitting drive transistor in a light emitting stage, and a first terminal of the storage capacitor is electrically connected to the second electrode of the data writing transistor, and a second terminal of the storage capacitor is electrically connected to the gate electrode of the light emitting drive transistor, the light emitting control circuit comprises a first light emitting control transistor, the first light emitting control transistor is used for conducting the storage capacitor and the first power supply terminal in the light emitting stage, and a first electrode of the first light emitting control transistor is electrically connected to a third power supply terminal, a second electrode of the first light emitting control transistor is electrically connected to the first terminal of the storage capacitor, and a gate electrode of the first light emitting control transistor is electrically connected to a light emitting control line to receive the light emitting control signal, and the data writing transistor, the first compensation transistor, and the second compensation transistor are under a control of a same scanning signal.

2. The pixel circuit according to claim 1, wherein the first power supply terminal and the third power supply terminal are configured to output a same power supply voltage; alternatively, the first power supply terminal is integrated with the third power supply terminal.

3. The pixel circuit according to claim 1, wherein the light emitting control circuit further comprises a second light emitting control transistor, and a first electrode of the second light emitting control transistor is electrically connected to the second electrode of the light emitting drive transistor, a second electrode of the second light emitting control transistor is electrically connected to the first terminal of the light emitting element, and a gate electrode of the second light emitting control transistor is electrically connected to the light emitting control line to receive the light emitting control signal.

4. The pixel circuit according to claim 1, wherein the constant current source is configured to output the compensation current signal, and the light emitting drive transistor is at a saturated state in a data writing stage, and the compensation current signal flows through the light emitting drive transistor.

5. A driving method applied to the pixel circuit according to claim 1, comprising:

writing the data signal to the storage circuit, and writing the compensation voltage information which is based on the compensation current signal to the light emitting drive circuit, in a data writing stage;

driving the light emitting element to emit light based on the compensation voltage information, in a light emitting stage.

6. The driving method according to claim 5, wherein the light emitting drive circuit comprises a light emitting driving transistor, and writing the compensation voltage information which is based on the compensation current signal to the light emitting drive circuit comprises:

writing the compensation current signal to a gate electrode of the light emitting drive transistor, and controlling the light emitting drive transistor to be at a saturated state to write the compensation voltage information to the gate electrode of the light emitting drive transistor.

7. A display panel, comprising the pixel circuit according to claim 1.

8. The display panel according to claim 7, further comprising a constant current source, wherein the constant current source is configured to output the compensation current signal.

9. A display device, comprising the display panel according to claim 7.

10. The pixel circuit according to claim 1, wherein the data writing circuit comprises a data writing transistor, and a first electrode of the data writing transistor is electrically connected to a data line, a second electrode of the data writing transistor is electrically connected to the storage circuit, and a gate electrode of the data writing transistor is electrically connected to the scanning signal line to receive the scanning signal.

11. The pixel circuit according to claim 10, wherein the storage circuit comprises a storage capacitor, and a first terminal of the storage capacitor is electrically connected to the second electrode of the data writing transistor, and a second terminal of the storage capacitor is electrically connected to the gate electrode of the light emitting drive transistor.

12. The pixel circuit according to claim 11, wherein the light emitting control circuit comprises a first light emitting control transistor, and a first electrode of the first light emitting control transistor is electrically connected to a third power supply terminal, a second electrode of the first light emitting control transistor is electrically connected to the first terminal of the storage capacitor, and a gate electrode of the first light emitting control transistor is electrically connected to a light emitting control line to receive the light emitting control signal.

13. The pixel circuit according to claim 12, wherein the first power supply terminal and the third power supply terminal are configured to output a same power supply voltage; alternatively, the first power supply terminal is integrated with the third power supply terminal.

14. The pixel circuit according to claim 12, wherein the light emitting control circuit further comprises a second light emitting control transistor, and a first electrode of the second light emitting control transistor is electrically connected to the second electrode of the light emitting drive transistor, a second electrode of the second light emitting control transistor is electrically connected to the first terminal of the light emitting element, and a gate electrode of the second light emitting control transistor is electrically connected to the light emitting control line to receive the light emitting control signal.

* * * * *